US010308469B2

(12) United States Patent
Kauppila

(10) Patent No.: US 10,308,469 B2
(45) Date of Patent: Jun. 4, 2019

(54) APPARATUS FOR FORMING SHEETS OF DIFFERENT LENGTHS OR SHEETS WITH DIFFERENT PANEL LENGTHS

(71) Applicant: Greg M. Kauppila, Ashland, WI (US)

(72) Inventor: Greg M. Kauppila, Ashland, WI (US)

(73) Assignee: C.G. Bretting Manufacturing Co., Inc., Ashland, WI (US)

( * ) Notice: Subject to any disclaimer, the term of this patent is extended or adjusted under 35 U.S.C. 154(b) by 566 days.

(21) Appl. No.: 15/050,103

(22) Filed: Feb. 22, 2016

(65) Prior Publication Data

US 2016/0264373 A1 Sep. 15, 2016

Related U.S. Application Data

(60) Provisional application No. 62/132,855, filed on Mar. 13, 2015.

(51) Int. Cl.

| | |
|---|---|
| ***B65H 35/00*** | (2006.01) |
| ***B65H 20/02*** | (2006.01) |
| ***B65H 37/06*** | (2006.01) |
| ***B65H 45/20*** | (2006.01) |
| ***B65H 45/24*** | (2006.01) |

(52) U.S. Cl.

CPC ..... *B65H 35/008* (2013.01); *B65H 20/02* (2013.01); *B65H 37/06* (2013.01); *B65H 45/20* (2013.01); *B65H 45/24* (2013.01)

(58) Field of Classification Search

None

See application file for complete search history.

(56) References Cited

U.S. PATENT DOCUMENTS

| | | | | |
|---|---|---|---|---|
| 7,717,839 | B2 * | 5/2010 | Butterworth | B65H 45/24 270/39.05 |
| 7,998,050 | B2 | 8/2011 | De Matteis | |
| 8,123,665 | B2 * | 2/2012 | De Matteis | B26D 1/425 270/39.01 |
| 8,696,537 | B2 | 4/2014 | Cline et al. | |
| 2007/0082800 | A1 * | 4/2007 | Kauppila | B65H 45/24 493/427 |
| 2007/0161487 | A1 * | 7/2007 | Ryczek | B26D 1/385 493/427 |
| 2009/0137375 | A1 * | 5/2009 | Tsai | B31F 1/10 493/442 |
| 2012/0165174 | A1 * | 6/2012 | Butterworth | B31F 1/0003 493/451 |

* cited by examiner

*Primary Examiner* — Hemant Desai
*Assistant Examiner* — Tanzim Imam
(74) *Attorney, Agent, or Firm* — Reinhart Boerner Van Deuren P.C.

(57) ABSTRACT

Apparatuses and methods of forming sheets having different lengths are provided. The apparatuses and methods may also be used to form panel lengths of different values using a same processing roll. In some embodiments, the diameter of the roll need not change. In some embodiments, the spacing between adjacent rolls need not be changed when transitioning from one sheet length to another sheet length. In some embodiments, the processing roll includes an excess material receiving component that can be active or deactivated to switch between different sheet sizes.

19 Claims, 13 Drawing Sheets

APPARATUS FOR FORMING SHEETS OF DIFFERENT LENGTHS OR SHEETS WITH DIFFERENT PANEL LENGTHS

CROSS-REFERENCE TO RELATED PATENT APPLICATION

This patent application claims the benefit of U.S. Provisional Patent Application No. 62/132,855, filed Mar. 13, 2015, the entire teachings and disclosure of which are incorporated herein by reference thereto.

FIELD OF THE INVENTION

This invention generally relates to web material converting machines for forming sheets of web material and particularly folded sheets of web material and even more particular stacks of folded sheets of web material.

BACKGROUND OF THE INVENTION

Current web material converting machines are limited to having a single, distinct, folded panel length with the potential ability to have various cutoff lengths (sheet lengths) which are a multiple of the single, distinct, folded panel length (2, 3, 4, etc. panel products with cutoff lengths divisible by the same single, distinct, panel length). As such, the machine cannot make panel lengths of different dimensions. More particularly, if a machine is configured to make panel lengths of 5 inches, the machine typically cannot be quickly changed to make panel lengths of 5.125 inches. In this example, the 5 inch panel length would result in a sheet length for a sheet with 2 panels of 10 inches, a sheet with 3 panels would have a sheet length of 15 inches and a sheet with 4 panels would have a sheet length of 20 inches, etc. The 5.125 inch panel length would result in sheets with 2 panels having a sheet length of 10.25 inches, sheets with 3 panels having a sheet length of 15.375 inches and sheets with 4 panels having sheet lengths of 20.5 inches, etc.

There is not a current method or apparatus to produce multiple panel lengths using the same set of processing rolls (knife roll, lap roll, folding roll, etc.). Current means of achieving multiple panel lengths on a single machine involve having multiple sets of processing rolls that can be exchanged with each other or are located in different positions where the web path needs to be altered to go between the different sets of processing rolls.

Typically, the outer circumference of the processing rolls relates to a multiple of the panel lengths.

BRIEF SUMMARY OF THE INVENTION

In one embodiment, an apparatus for forming sheets of web material of different lengths is provided. The apparatus includes a cutting arrangement for cutting the web of material into sheets at a cutting location. The cutting arrangement includes a roll receiving a web of material on an outer periphery thereof and carrying the web of material past the cutting location. The roll rotates about a rotational axis. The roll has an excess material receiving component having a first mode and a second mode. In the first mode, a first extent of material is accommodated by the excess material receiving component to form sheets of a first length. In the second mode, a second extent of material is accommodated by the excess material receiving component to form sheets of a second length. The second extent of material being greater than the first extent. The roll rotates about the rotational axis a first arc angle that is the same amount for forming sheets of the first and second lengths.

In one embodiment, the excess material receiving component includes a ditch formed by the roll. The amount of web received in the ditch defines the first and second extents of material accommodated by the excess material receiving component. In one embodiment, the first extent is zero material.

In one embodiment, the excess material receiving component includes at least one vacuum port in fluid communication with the ditch. The vacuum port provides vacuum in the second mode to hold the second extent of material in the ditch.

In one embodiment, the vacuum port is deactivated in the first mode to limit the amount of material accommodated therein.

In one embodiment, the excess material receiving component accommodates the second extent of material prior to passing the cutting location such that a sheet of the second length is formed by the cutting arrangement.

In one embodiment, a filling component placed in the ditch in the first mode to limit the amount of material able to be accommodated in the ditch in the first mode.

In one embodiment, the roll has a plurality of excess material receiving components. The plurality of excess material receiving components are spaced about the axis of the roll less than the first arc angle such that multiple excess material receiving components are used during the formation of each sheet of the second length.

In one embodiment, the apparatus further includes a folding arrangement downstream from the cutting arrangement. The folding arrangement is configured to fold the sheets to form multiple panels in the sheet. The roll has a plurality of excess material receiving components. The spacing of the plurality of excess material receiving components is such that at least one excess material receiving component aligns with each region of each sheet that will form a panel.

In one embodiment, a processing roll for handling sheets of web material of different lengths is provided. The processing roll includes a roll having an outer periphery including an excess material receiving component for receiving excess material and accommodating sheets of different lengths about the periphery of the roll.

In a particular embodiment, at least one sheet manipulation component is provided proximate the outer periphery of the roll. The roll defining a handling region adjacent the sheet manipulation component extending angularly about a rotational axis of the roll between a leading edge and a trailing edge. When a sheet of a first length is handled by the roll, the sheet is located with a leading edge proximate the leading edge of the handling region and with a trailing edge proximate the trailing edge of the handling region. When a sheet of a second length greater than the first length is handled by the roll, the sheet is located with a leading edge proximate the leading edge of the handling region and with a trailing edge proximate the trailing edge of the handling region such that the first and second sheets take up a same arc angle within the handling region.

In one embodiment, a difference in length between the first and second sheets is accommodated by the excess material receiving component when the sheets of a second length are handled by the processing roll.

In one embodiment, the excess material receiving component is a ditch formed by the processing roll.

In one embodiment, the excess material receiving component is a plurality of ditches formed by the processing roll.

In one embodiment, the excess material receiving component is an outward extending projection formed on the outer periphery of the processing roll.

In one embodiment, a method of processing sheets of web material is provided. The method includes handling a first set of folded sheets and a second set of folded sheets. Each sheet of the first set of folded sheets has at least one panel of a first predetermined length. Each sheet of the second set of folded sheets has at least one panel of a second predetermined length, the second predetermined length being greater than the first predetermined length.

In one embodiment, the steps of handling the first set of folded sheets and handling the second set of folded sheets are performed with a same first processing roll. The first processing roll includes a first excess material receiving component. During the step of handling the first set of folded sheets, a first extent of material is received by the excess material receiving component. During the step of handling the second set of folded sheets, a second extent of material is received by the first excess material receiving component. The second extent being greater than the first extent.

In one embodiment, handling the first set of folded sheets includes transferring the sheets of the first set of folded sheets to a second processing roll having a second excess material receiving component. Handling the second set of folded sheets includes transferring the sheets of the second set of folded sheets to a second processing roll. Transferring the sheets of the second set of folded sheets to the second processing roll includes transferring the second extent of material from the first excess material receiving component to the second excess material receiving component.

In a more particular embodiment, transferring the second extent of material from the first excess material receiving component to the second excess material receiving component occurs proximate a nip formed between the first and second processing rolls.

In one embodiment, the method includes retaining the second extent of material in the first excess material receiving component using a material retaining mechanism.

In one method, the material retaining mechanism is a vacuum port in fluid communication with the first excess material receiving component.

In one method, the material retaining mechanism is a mechanical gripper.

One method further includes biasing the second extent of material into the first excess material receiving component.

In one method, the step of biasing the second extent of material is performed by pushing the second extent of material with a projection of a biasing roll positioned adjacent the first processing roll.

In one method, the first excess material receiving component is in the form of a ditch provided by the first processing roll and the second extent of material is received in the ditch.

In one method, the first excess material receiving component is in the form of a plurality of ditches provided by the first processing roll and the second extent of material is received in at least one of the plurality of ditches.

In one method, the steps of handling the first set of folded sheets and handling the second set of folded sheets are performed with a same first processing roll. During the step of handling the first set of folded sheets, each first sheet extends angularly about a rotational axis of the first processing roll a first arc angle. During the step of handling the second set of folded sheets, each second sheet extends angularly about a rotational axis of the first processing roll a second arc angle. The first and second arc angles being equal.

In one method, handling the second set of folded sheets includes holding each of the second sheets on an upstream side of the first excess material receiving component at a first location and on a downstream side of the first excess material receiving component at a second location. Handling the second set of folded sheets further includes transferring the sheets of the second set of folded sheets to a second processing roll. Transferring includes holding each of the second sheets with the second processing roll at the first and second locations.

In one embodiment, a method of processing sheets of web material is provided. The method includes handling a first set of sheets with a processing roll. Each sheet of the first set of sheets has a first predetermined length extending between a leading edge and a trailing edge. Handling of the first sheets defines at least one first handling region. Each first handling region extends angularly a first arc angle about a rotational axis of the processing roll between a leading edge of the first handling region and a trailing edge of the handling region. The method includes handling a second set of sheets with the same processing roll. Each sheet of the second set of sheets is a second predetermined length extending between a leading edge and a trailing edge. The second predetermined length being greater than the first predetermined length. Handling of the second sheets defines at least one second handling region. Each second handling region extends angularly the first arc angle about the rotational axis of the processing roll between a leading edge of the second handling region and a trailing edge of the second handling region. The leading edge of the first handling regions being defined by leading edges of the first sheets and the trailing edge of the first handling regions being defined by trailing edges of the first sheets. The leading edge of the second handling regions is defined by leading edges of the second sheets and the trailing edge of the second handling regions being defined by trailing edges of the second sheets.

In one embodiment, a first arc length between the leading edge and trailing edge of the first handling regions is equal to a second arc length between the leading edge and trailing edge of the second handling regions.

In one embodiment, a method of forming sheets of web material of different lengths is provided. The method includes in a first mode for forming sheets of a first length: receiving, by a cutting arrangement processing roll, a web of material, the cutting arrangement processing roll having a first excess material receiving component; receiving a first extent of material in the excess material receiving component; and severing the web of material after a predetermined amount of rotation of the cutting arrangement processing roll to form sheets of the first length. The method includes a second mode for forming sheets of a second length: receiving, by the cutting arrangement processing roll, the web of material; receiving a second extent of material in the excess material receiving component, the second extent of material being greater than the first extent of material; and severing the web of material after the predetermined amount of rotation of the cutting arrangement processing roll to form sheets of the second length.

In one embodiment, a difference between the first and second lengths is an integer multiple of the difference between the first and second extents of material.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
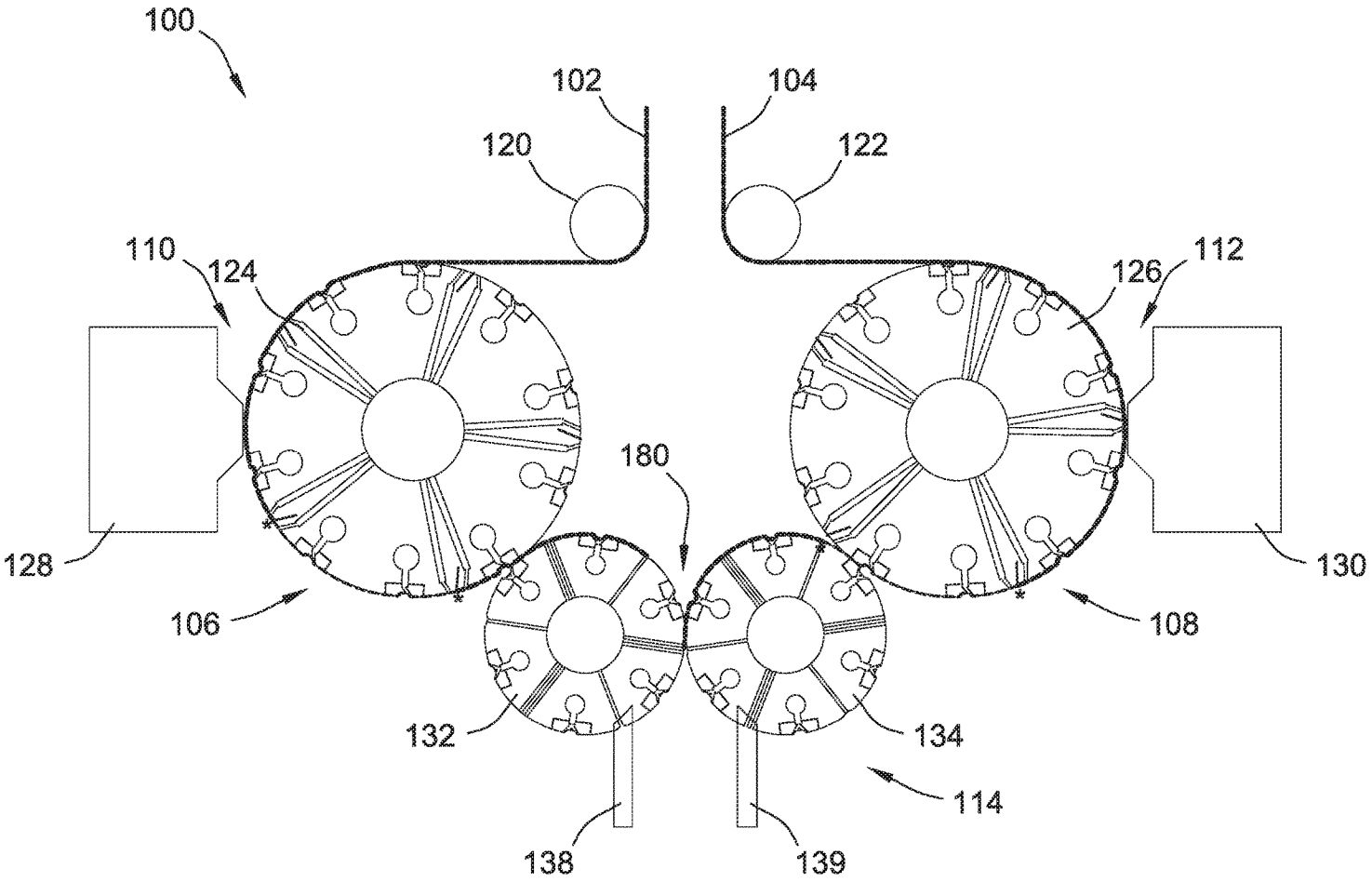
FIG. 1 is a simplified schematic illustration of web converting machine according to an embodiment of the present invention.
Figure 13:
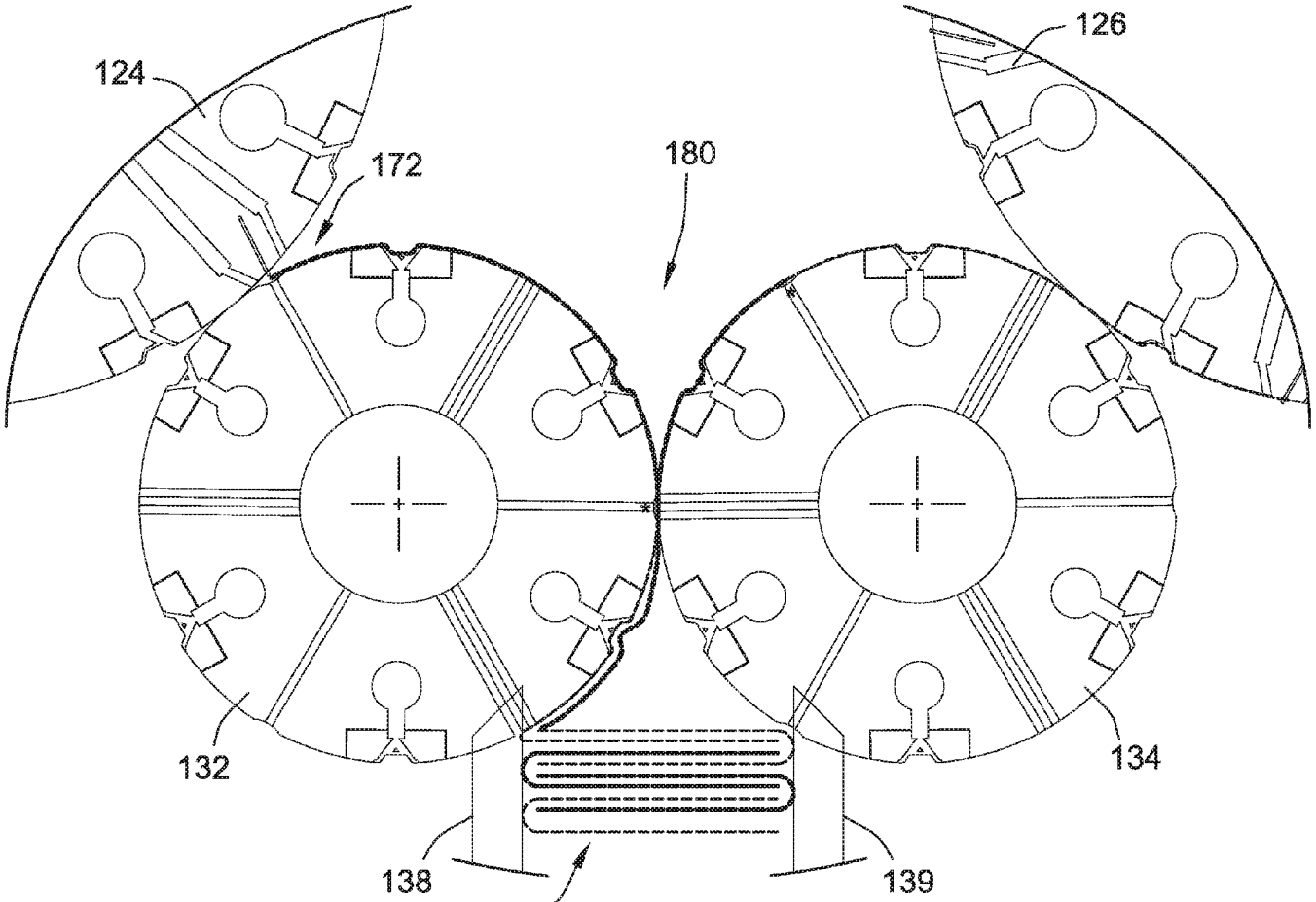
FIG. 13 is a partial illustration of the machine of FIG. 1 illustrating stack formation.
Figure 14:
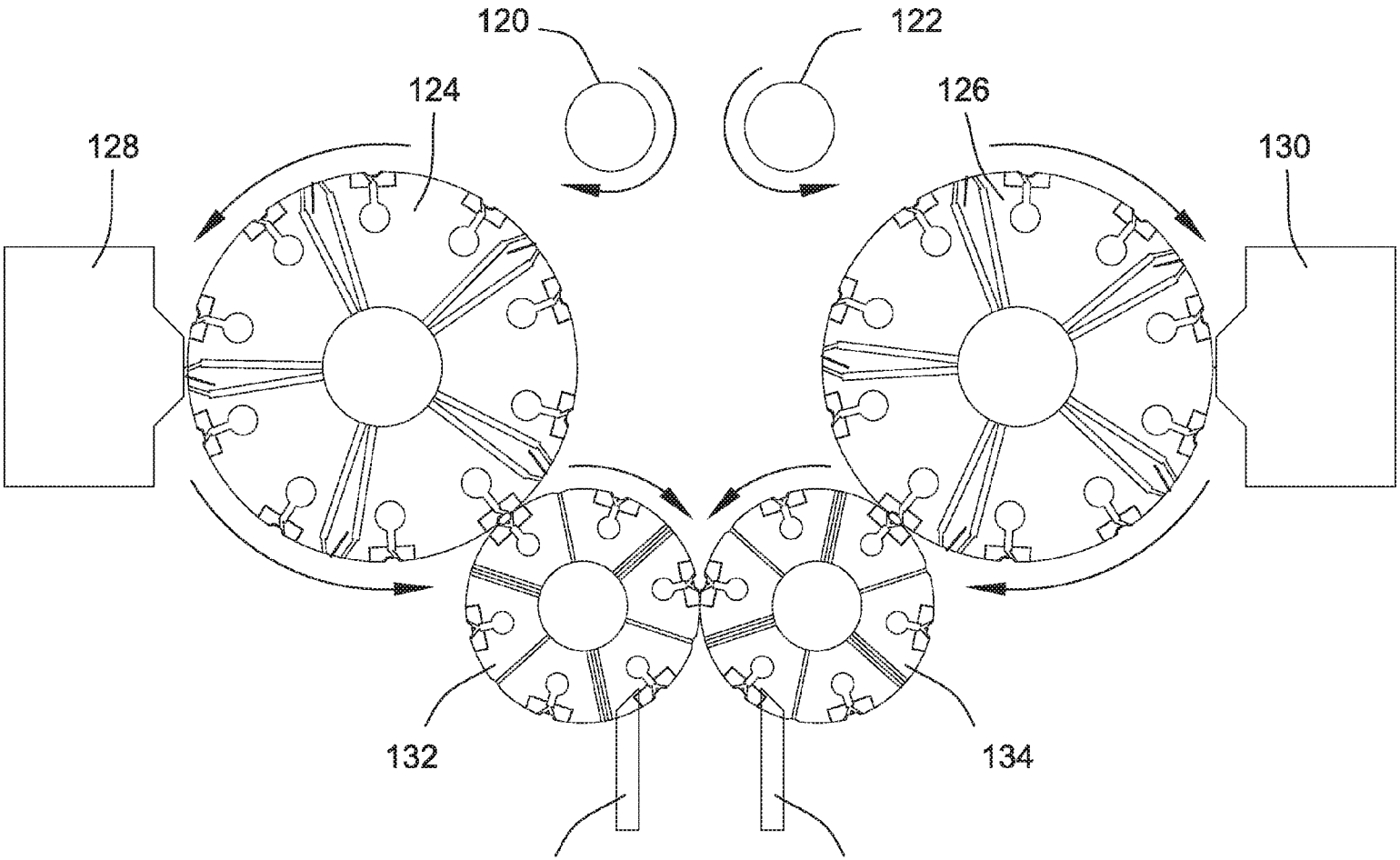
FIG. 14 is a simplified illustration of the machine of FIG. 1 without webs of material and identifying the direction of rotation of various components thereof.

FIG. 1 illustrates an embodiment of a web material converting machine 100 according to the teachings of the present invention illustrated in the form of an interfolding machine and more particularly in the form of a single-fold interfolding machine. The converting machine 100 takes incoming continuous webs of material 102, 104, severs the webs to form individual sheets 106, 108 using cutting arrangements 110, 112, interfolds the sheets 106, 108 using interfolding arrangement 114 and then forms a stack of the interfolded sheets 106, 108 (see also FIG. 13). It should be noted that features of the present invention can be utilized in different systems that use one or more than two webs.

Figure 2:
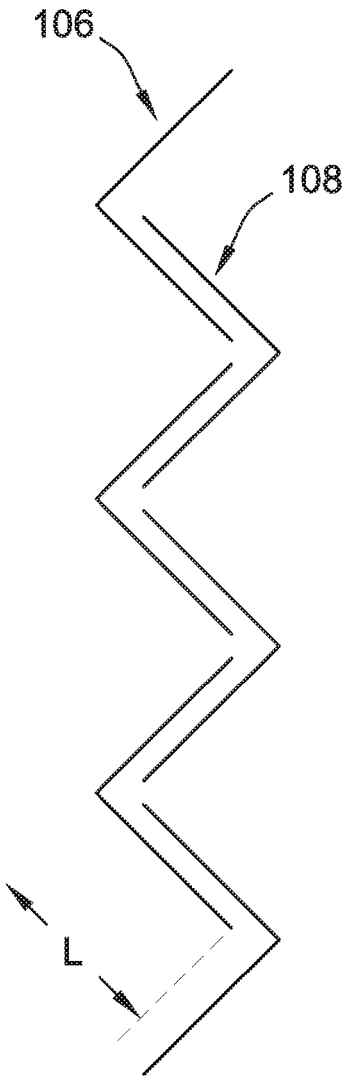
FIG. 2 is a simplified illustration of one form of interfolded sheet product that can be formed using the machine of FIG. 1.

With reference to FIG. 2, a schematic illustration of an example of interfolded sheets 106, 108 is provided. The converting machine 100 of FIG. 1 is configured to form sheets having panel length L of different values. For instance, in one embodiment, the converting machine 100 may be configured in a small panel mode that forms sheets with panel length L of 5 inches with a total sheet length L1 of 2L of approximately 10 inches and a large panel mode that forms sheets with panel length L of 5.125 inches with a total sheet length L1 of approximately 10.25 inches. It should be noted that features of the present invention can be utilized in different systems that form different sized panels and that form sheets with more than two panels such as multi-fold arrangements including, but not limited to, W- or Z-folded sheets or zig-zag patterned sheets. The features can also be used for both interfolded and non-interfolded arrangements. Further, while the illustrated concept accommodates two different sizes of sheet length L1 and panel length L, other systems could accommodate more than two sizes.

Returning to FIG. 1, the general components of the illustrated converting machine 100 will be identified. The continuous webs 102, 104, will be directed around idler rolls 120, 122 and toward cutting arrangements 110, 112.

The cutting arrangements 110, 112 include knife rolls 124, 126 that cooperate with corresponding anvils 128, 130. As the webs 102, 104 pass between the knife rolls 124, 126 and corresponding anvils 128, 130, the webs 102, 104 are severed into sheets 106, 108.

Figure 3:
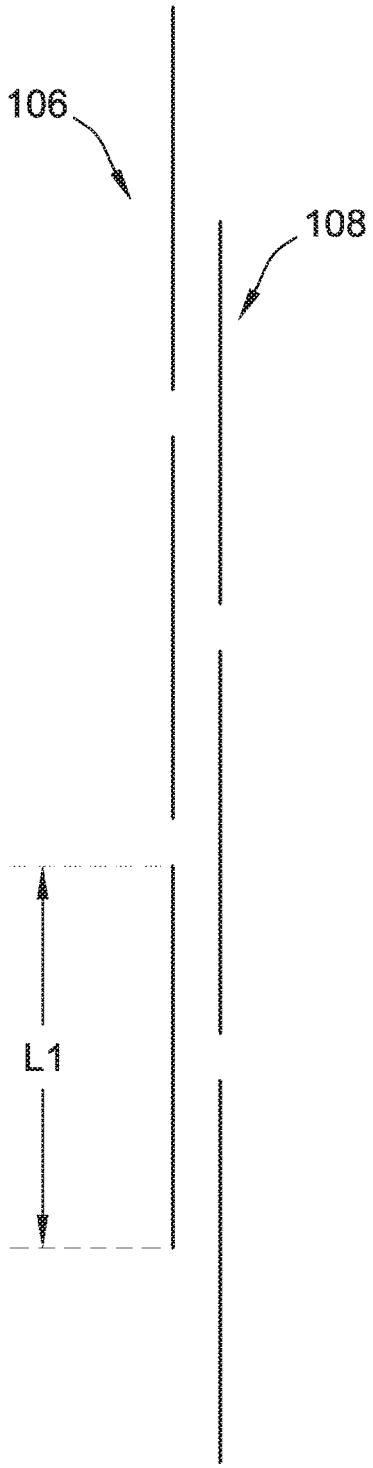
FIG. 3 is a simplified illustration of how sheets are aligned prior to being interfolded using the machine of FIG. 1.

The severed sheets 106, 108 are transferred by the knife rolls 124, 126 to the interfolding arrangement 114 including folding rolls 132, 134. The folding rolls 132, 134 are counter rotating rolls forming a folding nip 180 therebetween. The sheets 106, 108 arrive to the folding nip 180 one panel out of phase such that the streams of sheets 106, 108 are overlapped as illustrated in FIG. 3. This overlapped arrangement allows for the sheets 106, 108 to be interfolded into the configuration illustrated in FIG. 2 when the sheets 106, 108 pass through the folding nip 180 and are folded by the interfolding arrangement 114.

A pair of guides 138, 139 are downstream from the folding nip 180 and support the stack 116 (see FIG. 13) and help remove the sheets 106, 108 from the folding rolls 132, 134.

While the illustrated embodiment relates to single-folded sheets, other embodiments incorporating features of the invention may form multi-folded sheets, i.e. sheets folded more than one time to form more than 2 panels per sheet. Further, while the illustrated embodiment relates to interfolded sheets, other embodiments of the invention may form non-interfolded sheets such that adjacent sheets are merely stacked on top of one another rather than interfolded as illustrated in FIG. 3. Further, while multiple webs of material 102, 104 or shown in this embodiment, other embodiments can use more or less than two webs of material. The processing rolls are shown using vacuum ports for holding the sheets to the periphery of the processing rolls and for forming the folds in the sheets 106, 108 as they pass through the folding nip 180. However, other embodiments can utilize mechanical interfolding and gripping components such as mechanical grippers and tuckers.

As noted above, typically, the panel length L of a sheet 106, 108 is fixed by the outer circumference of the processing rolls and the spatial relationship of the sheet manipulation components thereof. However, changing the diameter of the processing rolls to form panel length L of a different value can be difficult. One principle issue is that the special relationship between adjacent rolls and particularly the spacing between the rotational axes of adjacent rolls would typically need to be adjustable to accommodate the changing diameters of the adjacent rolls.

The outer circumferences of the processing rolls of the converting machine 100 are designed for the smallest possible panel length L, absent requiring slippage of the web material relative to a processing roll. This allows the smallest panel length products to be produced as they are currently using single-fold and multi-fold machines, again, assuming no or negligible slip between the web material and the processing rolls. When forming the smallest possible panel length products, the converting machine 100 may be considered to be operating in a small panel mode.

To produce products with a larger panel length L, extra paper must be located between the positions of the sheet manipulation components of the processing rolls, such as the knife blades of the knife rolls 124, 126 and the interfolding components such as tuckers and grippers of the folding rolls 132, 134.

Figure 4:
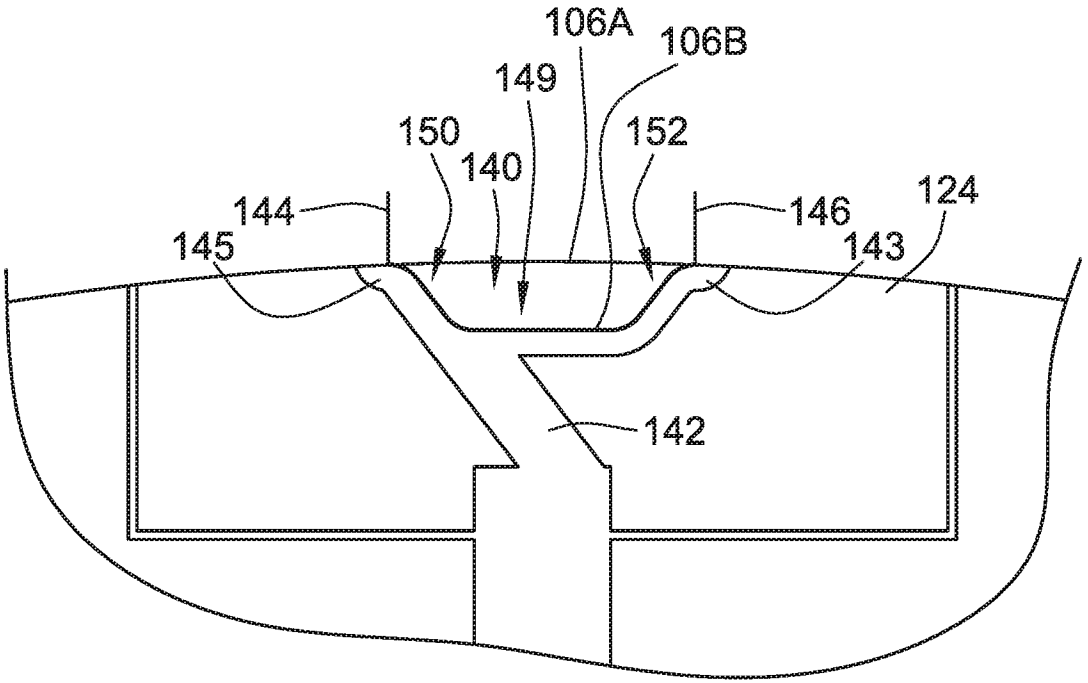
FIG. 4 is an enlarged partial illustration of a processing roll of the machine of FIG. 1 illustrating a ditch formed therein illustrating how web interacts with the ditch in both a large and a small operational mode.

With principle reference to FIG. 4, in one embodiment, to accommodate this excess material, the processing rolls include one or more excess material receiving component in the form of material receiving ditches. The processing roll illustrated in FIG. 4 is knife roll 124 and includes ditch 140. The ditch 140 increases the effective surface (or path length) of the rolls between fixed position sheet manipulation components of a given processing roll. As this is a knife roll 124, the sheet manipulation components thereof are the knife blades for severing the web.

The use of the ditch 140 allows the path length of the sheet about the roll 124 to act as if the outer periphery of the roll has increased without actually requiring the diameter of the roll to change in this embodiment. As noted above, changing the diameter could require changes such as to the distance between the rotational axes of adjacent rolls. When utilizing the ditch 140 in the large mode, the panel length L will be larger than when not used in the small mode as excess material is received in the ditch 140.

The ditch 140 of FIG. 4 could have an arc shape, square shape, v shape, trapezoidal shape, etc.

In some embodiments, a material retaining mechanism can be used to keep the excess web in the ditch 140 when operating in a large panel mode. The material retaining mechanism in the illustrated embodiment is provided by a primary vacuum port 142. In other embodiments, the material retaining mechanism could be mechanical such as in the form of a gripper mechanism. In some embodiments, such as the illustrated embodiment, vacuum port 142 is connected to secondary vacuum ports 143, 145. These vacuum ports help secure the material upstream and downstream of the ditch 140. Some embodiments need not have both secondary vacuum ports and only a single secondary vacuum port, either upstream or downstream, could be provided.

In the small mode, the web material is kept out of the ditch 140 and merely spans across the mouth of the ditch 140 from location 144 to location 146 unsupported by the roll, such as illustrated by web 106A in FIG. 4. However, in other embodiments, in the small mode, a filler component could be mounted in ditch 140 to fill the void to prevent the web of material from extending therein. The filler component could simply be a plate mounted within the ditch 140. The filler component could have perforations therein such that vacuum supplied by vacuum port 142 could still be used to hold the web of material against the outer periphery of the roll, however, that is not necessary. As such, in some embodiments, the vacuum port 142 could be entirely deactivated in the small mode.

In the large mode, the excess material extends into the ditch 140 and lays on the additional surface provided by the bottom 149 and walls 150 and 152 of the ditch 140. The difference between the additional surface (path length) provided by the ditch 140 and the distance from locations 144 and 146 typically defines the difference between the panel length L in the small and large modes.

Figure 15:
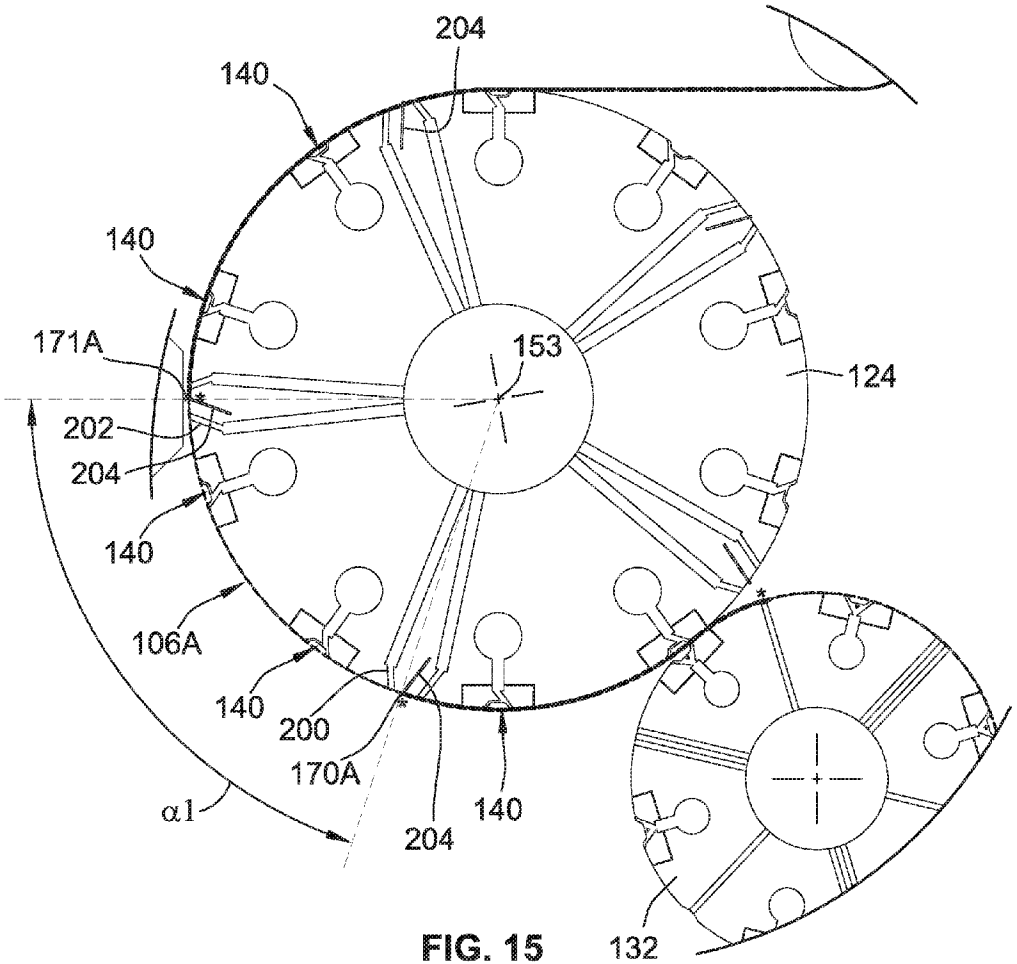
FIGS. 15 and 16 illustrate formation of sheets of different lengths using a same arc length about a rotational axis of a processing roll but using an excess material receiving component.
Figure 16:
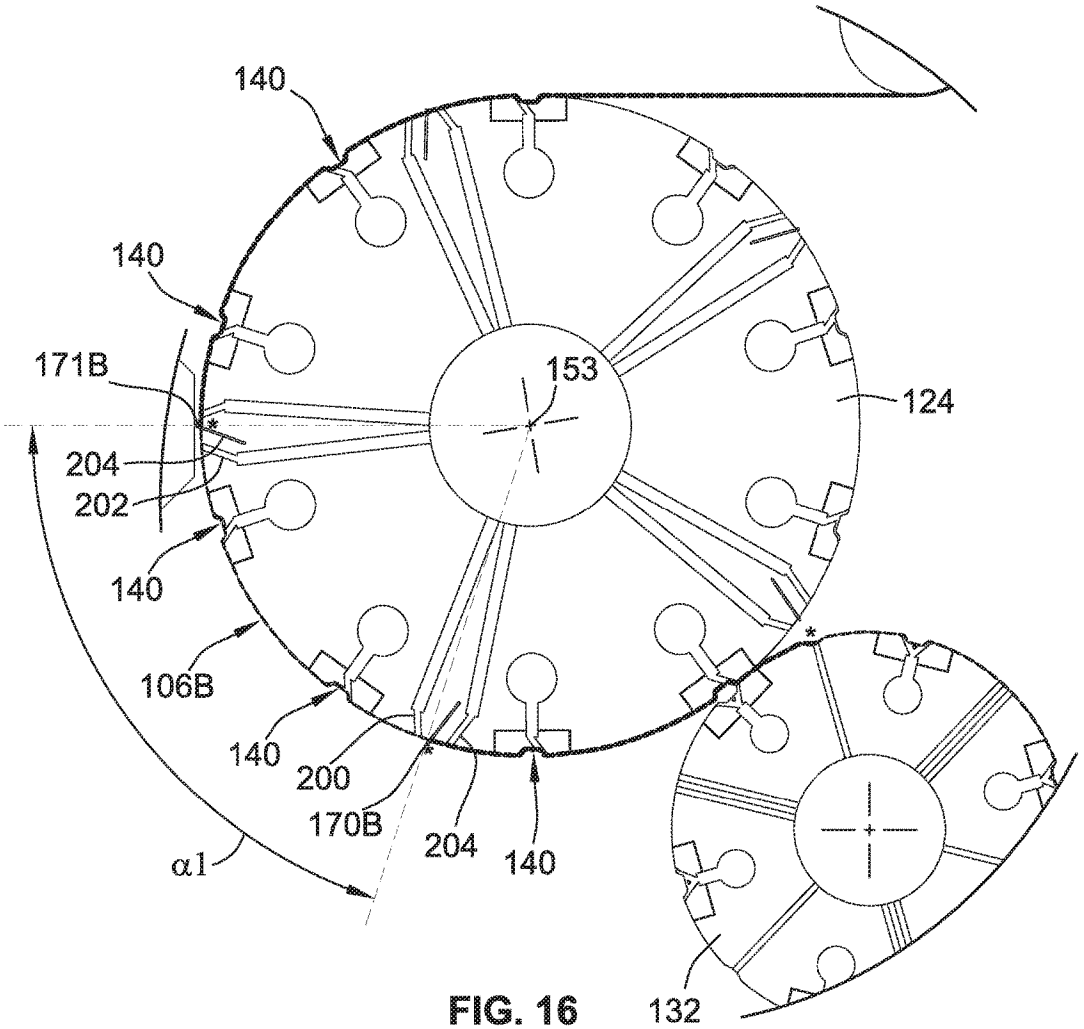

With additional reference to FIGS. 15 and 16, it can be seen that the large and small sheets are both accommodated within a same arc angle $\alpha 1$ about the rotational axis 153 of the processing roll 124. More particularly, the leading edges 170A and 170B of the small sheet 106A and large sheet 106B, respectively, are located at the same angular position about the rotational axis 153 while the trailing edges 171A and 171B of the small sheet 106A and large sheet 106B, respectively are located at the same angular positions about rotational axis 153. More particularly, the leading edges 170A, 170B are both being held by vacuum port 200 while the trailing edges 171A, 171B are both being held by vacuum port 202.

Further, the arc angle $\alpha 1$ is generally defined between sheet manipulation components in the knife blades 204 that sever the web of material into the individual sheets. The knife blades 204 generally stay at a constant angular location about axis 153 so as to maintain constant sheet lengths L1.

The extent of a processing roll on which a sheet is carried during handling of the sheet by the roll can be referred to as a sheet handling region of the corresponding roll. This sheet handling region generally defines the path and thus path length along the outer periphery of the roll for a given sheet. In the large mode, e.g. FIG. 16, the sheet handling region includes the surface that defines ditch 140. In the small mode, e.g. FIG. 15, the sheet handling region does not include the surface of the roll that defines ditch 140 because the sheet 106A spans the mouth of ditch 140 and is unsupported in this location. It is noted that in this embodiment, the sheet handling regions of the processing roll extends through the same arc angle $\alpha 1$ about the axis 153 and generally extends between adjacent knife blades 204. The sheet path provided by the sheet handling regions for the different size sheets is different so as to accommodate the difference in desired sheet and/or panel lengths.

It should be noted, in other embodiments or configurations, such as if the sheet was desired to be twice as long, such as for a four panel configuration, a sheet handling region could be formed between two non-adjacent sheet manipulation components, e.g. knife blades 204. Further, depending on the size of a given roll, a sheet handling region could be more than 360 degrees about the axis of rotation of the roll. This could happen if the roll had an outer peripheral dimension being less than the sheet length. Further, the entire sheet handling region need not be in use on a sheet at a same time.

In the small mode, a first extent of web material, i.e. almost nothing or nothing at all, is received in ditch 140 while in the large mode a second extent of web material, i.e. much more than the first extent, is received in ditch 140. As such, in the small mode, in some embodiments, the first extent may be negligible.

While only two ditches 140 (one for each panel) are illustrated between adjacent sheet manipulation components, multiple ditches could be provided for each panel to increase the amount of excess material that can be accommodated. Further, a single ditch could have numerous undulations so as to further increase the path length between locations 144 and 146 in the illustrated embodiment to accommodate more excess material to increase the difference in the panel length L between the small and large modes.

While the size of the ditch 140 in FIG. 4 is generally illustrated as being fixed, devices can be used to change the size thereof to adjust the amount of material accommodated therein and thus vary the difference between the panel length L in the small and large modes. For instance, in some embodiments, an insert could be located in ditch 140 to reduce the depth of ditch 140 and thus reduce the amount of excess material included therein. Further, inserts could be added that completely eliminate ditch 140 for use in the small mode such that sheet 106A need not span a void in the processing roll, but, instead, it rests on the outer surface of the insert (not shown). The ditches 140 could also automatically change in size. For instance, the bottom 149 could move radially relative to sidewalls 150, 152 to adjust the ditch size and the path length from locations 144 to 146.

There can be different ditch sizes for larger or smaller differences between the different possible panel lengths L or sheet lengths L1.

When switching between the large and small modes, e.g. using the ditch 140 and not using the ditch 140, it can be viewed as changing the functional path length or sheet handling region of the processing roll. By using the ditches, this change can occur without having to change the diameter of the processing roll simply by changing the path length (e.g. sheet handling region) along the outer periphery of the processing roll.

Figure 5:
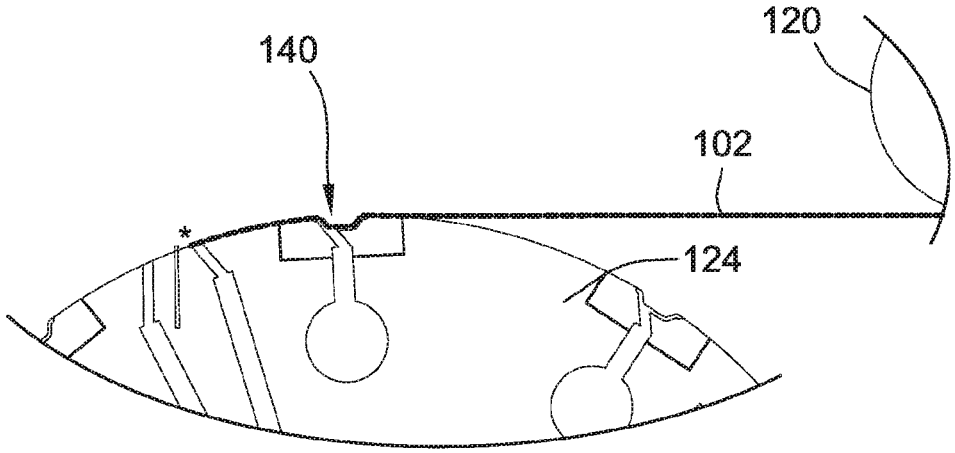
FIG. 5 is a partial illustration of the processing roll with web of material in the ditch thereof.

Further, operation of the large mode will now be described. As the operation for the left half of web converting machine 100 is substantially the same as the right half, only the left half will be described. With reference to FIGS. 1 and 5, as the web 102 comes off of the idler roll 120 and on to the knife roll 124, vacuum and or a mechanical means will force the web 102 into ditch 140 prior to being cut by the knife anvil 128.

Figure 6:
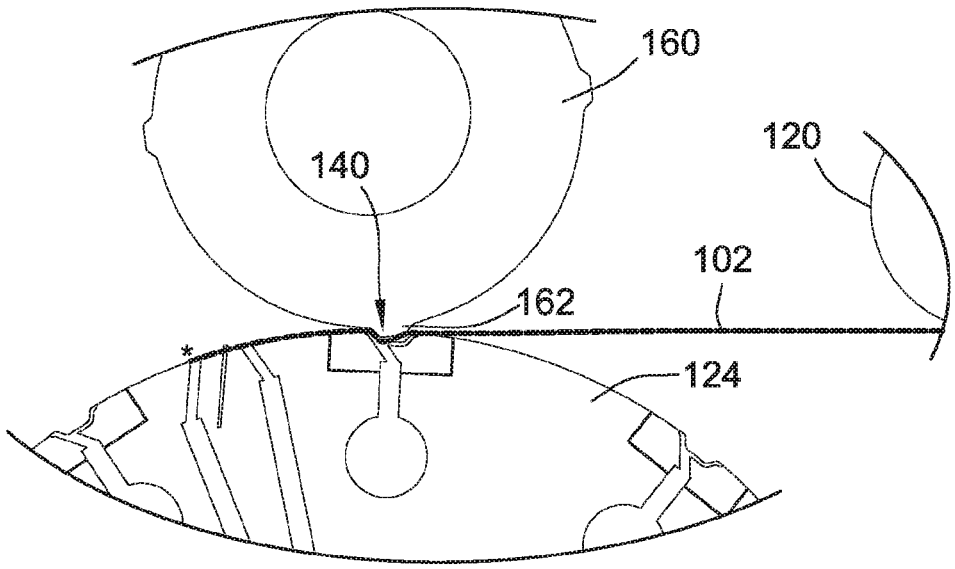
FIG. 6 is an alternative embodiment that utilizes a mechanism for forcing the web of material in the ditch of the processing roll of FIG. 5.

FIG. 6 illustrates a biasing mechanism for forcing the excess web into ditch 140. In this embodiment, the biasing mechanism is a biasing roll 160 that includes a biasing projection 162 for forcing excess web 102 into ditch 140. In the illustrated embodiment, the biasing projection 162 is shaped and sized to correspond to the shape and size of the ditch 140. In other embodiments, the projection may merely need to press a portion of the web into the ditch 140. The biasing projection 162 could be integrally formed with roll 160 or could be a replaceable component so as to accommodate different ditch configurations and sizes. Alternatively, an air device could be used to force the excess paper into the ditch 140. Other biasing members could be, for example, linear pushers.

Once in the ditch 140, the material retaining mechanism, such as vacuum port 142, will retain the excess material within the ditch 140.

Figure 7:
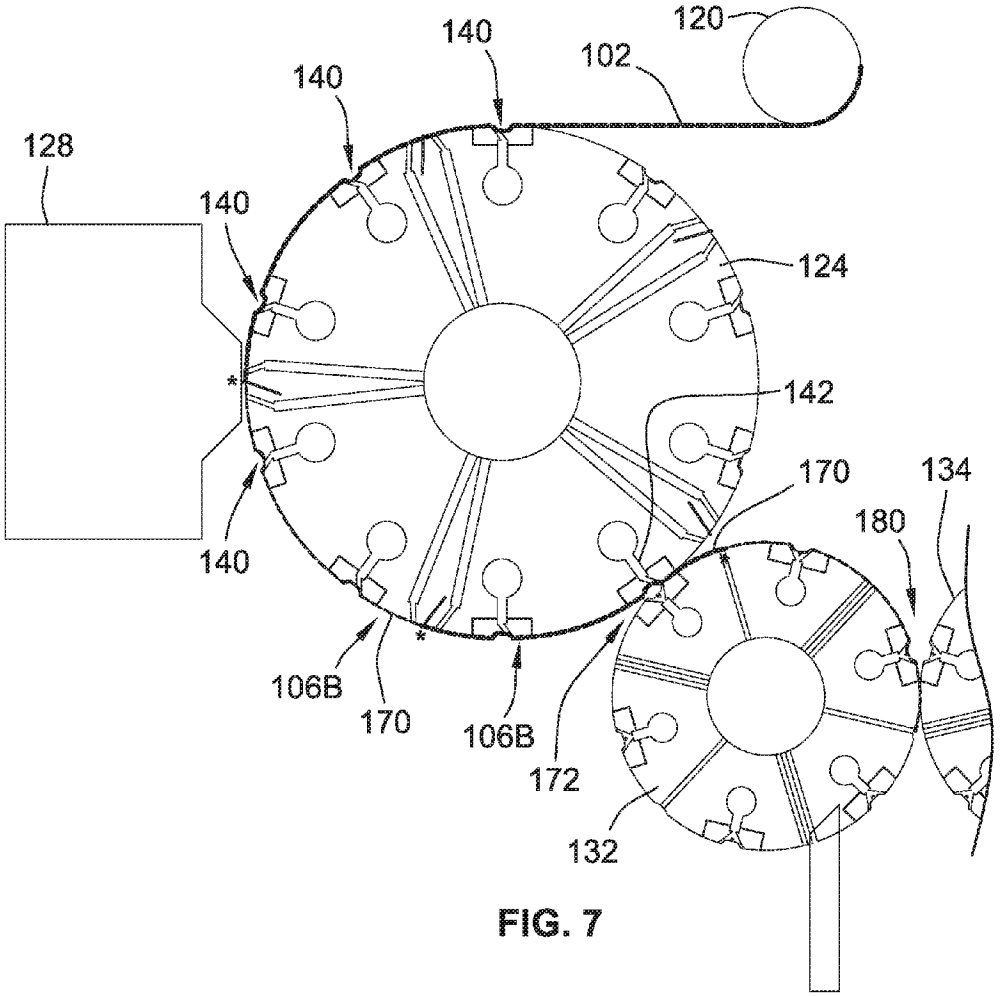
FIG. 7 is a partial illustration of the web converting machine of FIG. 1.

With reference to FIG. 7, with the web in the ditch 140, the web 102 is cut between the knife blade of on the knife roll 124 and the anvil on the anvil head 128. The individual sheets 106B are longer than the smallest possible cutoff for the set of rolls, i.e. when the web does not extend into ditches 140.

Figure 8:
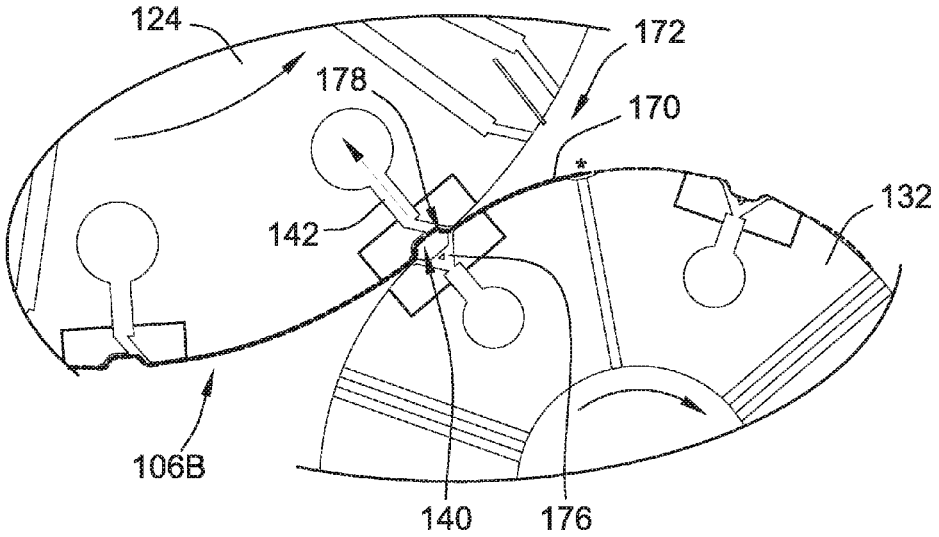
FIGS. 8 and 9 are partial illustrations of a knife roll and a folding roll illustrating the transfer of web material from the ditch of one roll to the ditch of the other roll.
Figure 9:
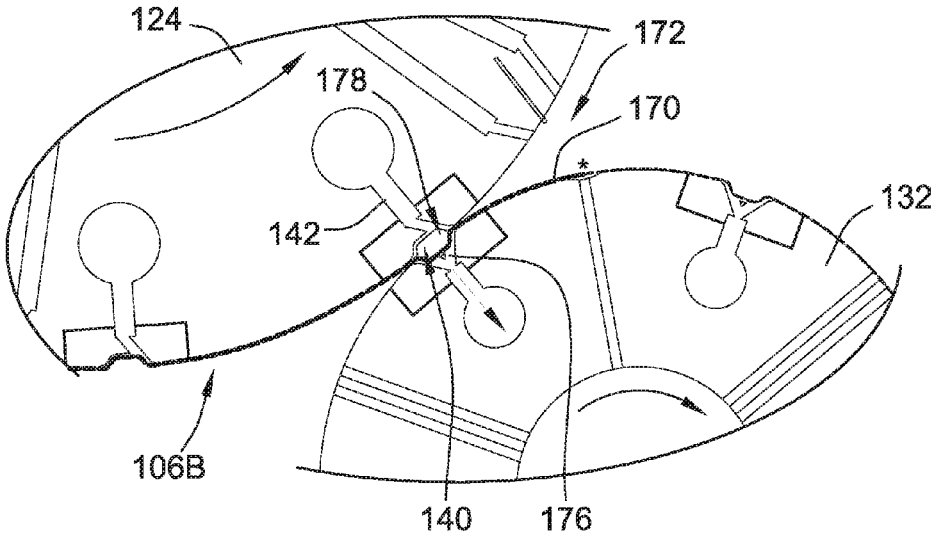

With reference to FIGS. 8 and 9, after the sheets 106B are cut to length, the lead edge 170 of each sheet 106B is transferred from the knife roll 124 to the folding roll 132. After the lead 170 is transferred to the folding roll 132, the web in the ditch also needs to be transferred to the folding roll 132. At a knife roll/folding roll nip 172, the material retaining mechanism, e.g. vacuum port 142, is deactivated in the knife roll 124. A material retaining mechanism, e.g. vacuum port 176, is activated in the folding roll 132. In this embodiment, during this transition through the knife roll/folding roll nip 172, the "bubble" of excess web material in ditch 140 is inverted from the knife roll 124 into ditch 178 of the folding roll 132. This passing from ditch 140 to ditch 178 allows the excess web to remain in a ditch in the folding roll 132 so that the panel length is longer than if the web was not in the ditch 178 at all.

While it is preferred to transfer the excess material from an excess material receiving component of one roll to an excess material receiving component of the next roll, other embodiments may not require the excess material to be so transferred. Instead, in some embodiments, less than all of the rolls include the excess material receiving components. Once the length of the sheets and/or panels is determined by use or non-use of the excess material receiving component of an upstream roll, the excess material may merely be held to the downstream processing roll on both sides thereof, such as at upstream and downstream locations 144 and 146 in FIG. 4. The material between locations 144 and 146 may be left free.

Figure 10:
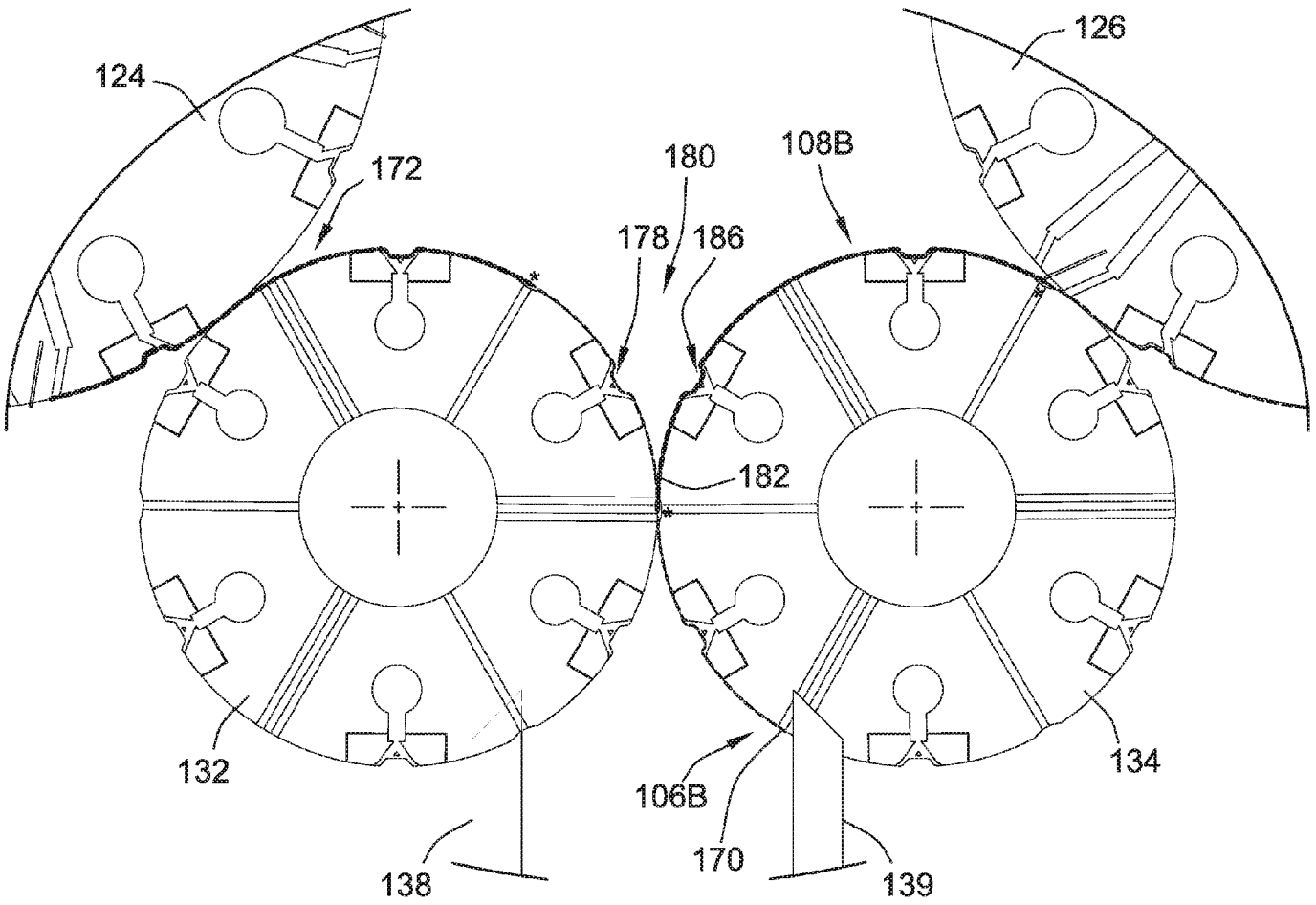
FIGS. 10-12 illustrate the sheets of web passing through the folding nip of the machine of FIG. 1 and the transfer of excess web material from ditch to another.

Just as in normal folding operations, there is gripper and tucker interaction to pass portions of the individual sheets from folding roll to folding roll to create the folds in the sheets. As shown in FIG. 10, the lead edge 170 of one sheet 106B has already passed through the folding nip 180 between folding rolls 132, 134 and from the left folding roll 132 to the right folding roll 134. The lead edge 182 of the sheet 108B is being transferred from the right folding roll 134 to the left folding roll 132.

Figure 11:
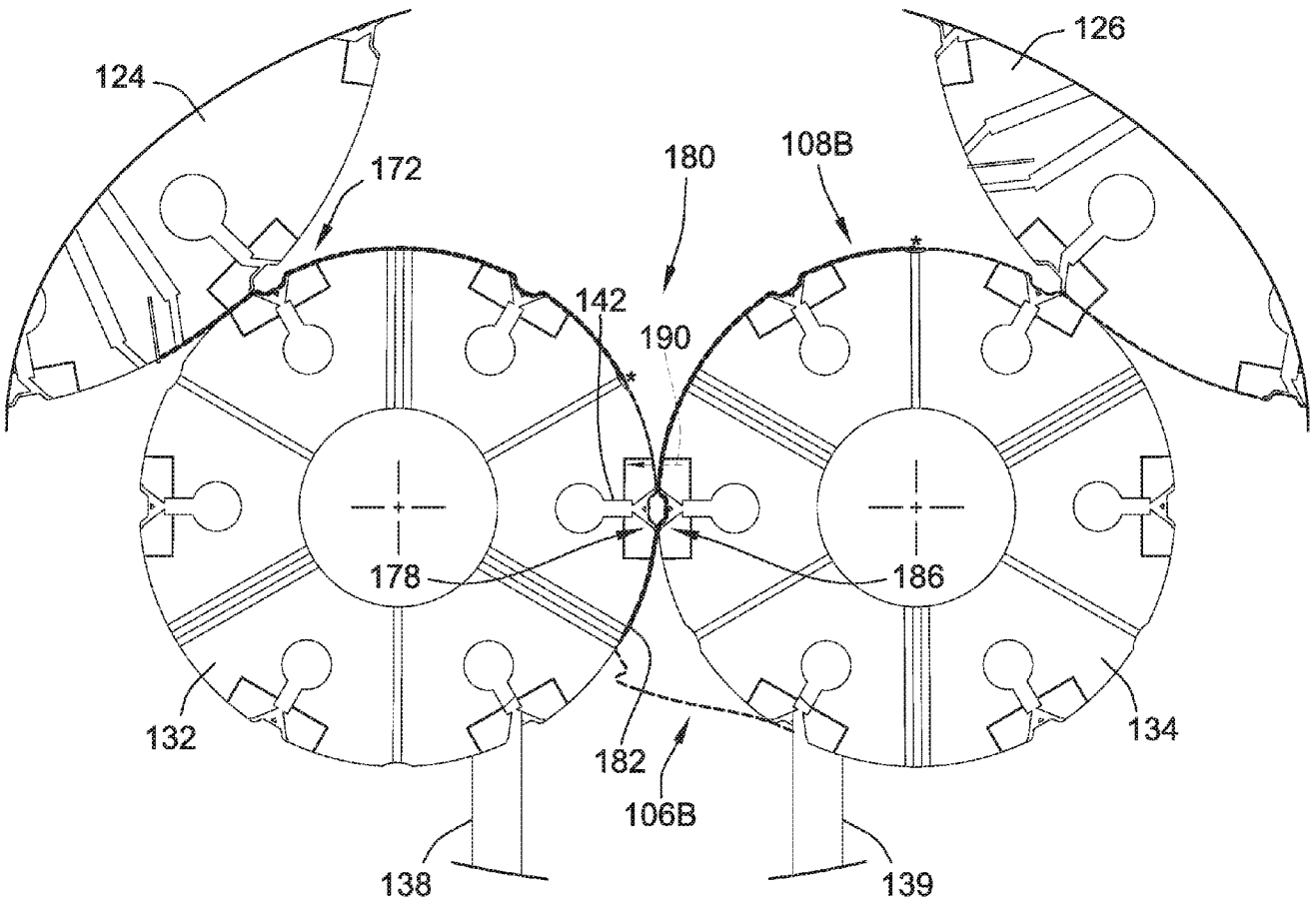

With reference to FIG. 11, after the lead edge 182 of sheet 108B has passed from the right folding roll 134 to the left folding roll 132 and through the folding nip 180, excess web in the ditches 178, 186 pass each other in the folding roll folding roll nip 180. More particularly, ditches 178, 186 generally align when passing through the folding nip 180. At (before or after) the nip 180, the vacuum and or mechanical device holding the excess web in the ditch 186 is deactivated allowing the excess web in ditch 186 to transfer to the opposite folding roll 132 as illustrated schematically by arrow 190.

Figure 12:
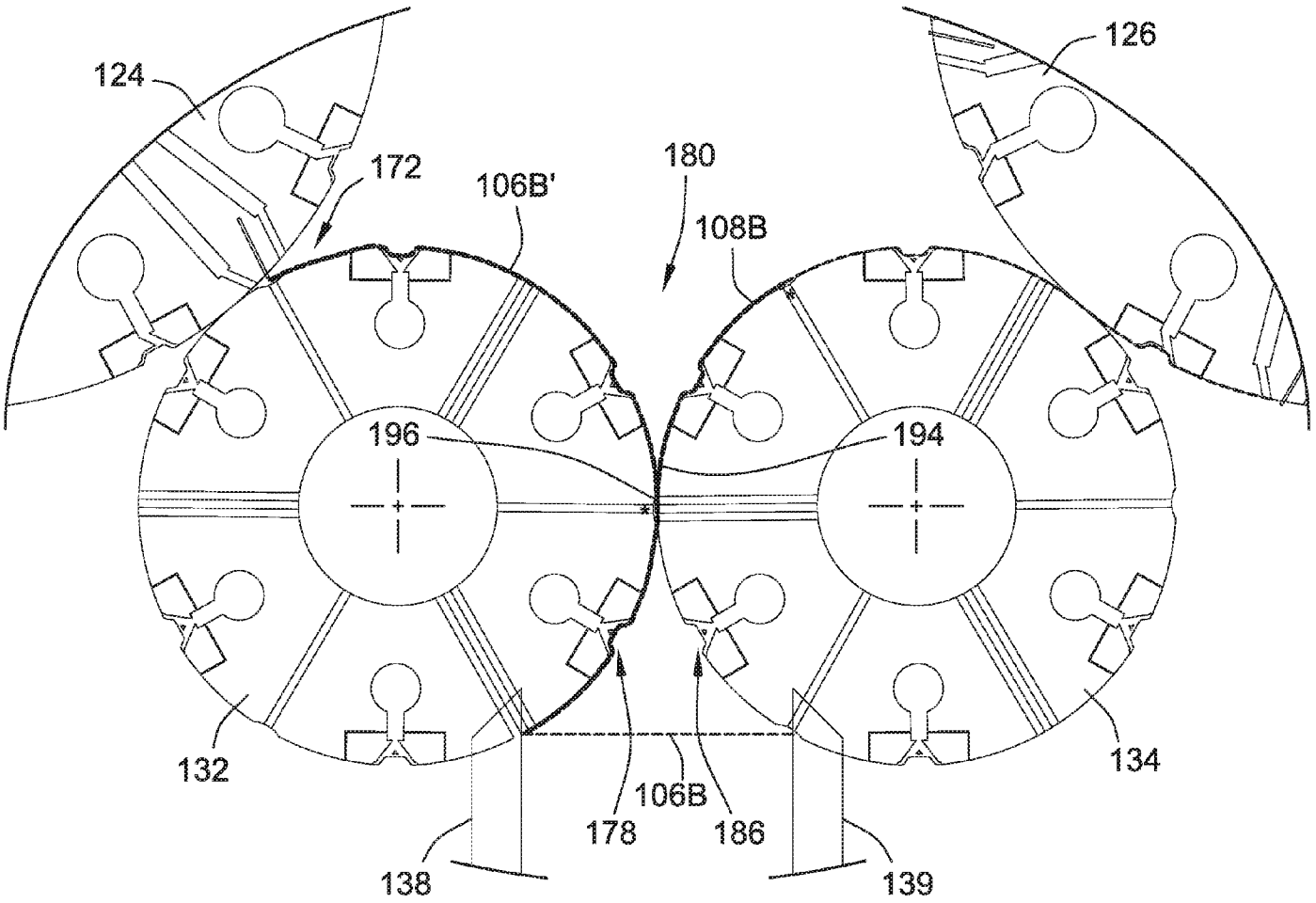

After the excess web is released by the material retaining mechanism associated with ditch 186 in the right folding roll 134 and is transferred to the opposite folding roll 132, the opposite ditch 186 may be deactivated. The shut off timing for the second ditch, i.e. the ditch holding the web directly in contact with the corresponding folding roll can be varied depending on the amount of excess paper it is holding to make a quality stack of folded product. FIG. 12 shows the excess web being held in ditch 178 after the folding nip 180.

At some point, the material retaining mechanism associated with ditch 178 will be deactivated such that the excess web held therein will be able to be stretched as the right folding roll 134 carries the leading end 196 of sheet 106B', a middle section 194 of sheet 108B and the fold formed thereat towards guide 139. This stretching of the excess web material allows the corresponding panels of sheets 106B' and 108B to lay flat when stacked between guides 138 and 139.

The spacing between the guides 138, 139 will typically be adjusted when switching between different panel length's. As such, in the small mode, the guides 138, 140 will typically be closer than in the large mode.

It is noted that the described embodiment generally would be used to form two separate sized sheets and/or panels and has thus been described as having a large and small mode. However, the invention is not limited to only two sizes and multiple sizes could be used depending on the configuration and the number of excess material receiving components.

Further, in some embodiments, not all of the panels of a folded sheet need to have the same length. As such, an excess material receiving component need not be provided for all panels of a given sheet product. However, in the illustrated embodiment of a system for forming sheets of two panels that are substantially equal in panel length L, the processing rolls have an excess material receiving component that will align with each panel of a given sheet so that each panel length can be properly adjusted to the desired value.

In some embodiments, it is contemplated that individual sheets could have different panel lengths by selectively activating and deactivating desired ones of the excess material receiving components. For instance, if it is desired to have the downstream panel larger than the upstream panel of single folded sheets, every other excess material receiving component would be active and particularly the one that aligns with the region of the sheet that ultimately results in the downstream panel.

Typically, this system will be used to form sheets of the same number of panels that have sheet lengths L1 that are no greater than 50% different in length. In some embodiments, the difference in length is less than 25%. In some embodiments, the difference is less than 20%. In even further embodiments, the sheet length difference is less than 10%.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. An apparatus for forming sheets of web material of different lengths, the apparatus comprising:

a cutting arrangement for cutting a web of material into sheets at a cutting location, the cutting arrangement including a roll receiving the web of material on an outer periphery thereof and carrying the web of material past the cutting location, the roll rotating about a rotational axis, the roll having an excess material receiving component having a first mode and a second mode;

wherein in the first mode, a first extent of material is accommodated by the excess material receiving component to form sheets of a first length;

wherein in the second mode, a second extent of material is accommodated by the excess material receiving component to form sheets of a second length, the second extent of material being greater than the first extent of material; and wherein the roll rotates about the rotational axis through a first arc angle that is the same for forming the sheets of the first and second lengths.

2. The apparatus of claim 1, wherein the excess material receiving component includes a ditch formed by the roll, an amount of the web received in the ditch defining the first and second extents of material accommodated by the excess material receiving component.

3. The apparatus of claim 2, wherein the excess material receiving component includes at least one vacuum port in fluid communication with the ditch, the vacuum port providing vacuum in the second mode to hold the second extent of material in the ditch.

4. The apparatus of claim 3, wherein the vacuum port is deactivated in the first mode.

5. The apparatus of claim 1, wherein the excess material receiving component accommodates the second extent of material prior to the sheets of the second length being formed by the cutting arrangement.

6. The apparatus of claim 2, further including a filling component placed in the ditch in the first mode to limit the amount of material able to be accommodated in the ditch in the first mode.

7. The apparatus of claim 1, wherein the roll has a plurality of excess material receiving components, the plurality of excess material receiving components being spaced angularly about the rotational axis by an angle less than the first arc angle such that multiple excess material receiving components are used during formation of each sheet of the second length.

8. The apparatus of claim 1, further including a folding arrangement downstream from the cutting arrangement, the folding arrangement configured to fold the sheets to form panels in the sheets;

wherein the roll has a plurality of excess material receiving components, spacing of the plurality of excess material receiving components being such that at least one excess material receiving component aligns with each region of each sheet that will form a panel of each sheet.

9. A method of processing sheets of web material, the method comprising:

forming a first set of sheets and a second set of sheets with the cutting arrangement of the apparatus of claim 1;

handling, with the roll of the cutting arrangement, the first set of sheets to be folded, each sheet of the first set of sheets to be folded having at least one panel of a first predetermined length after being folded; and handling, with the roll of the cutting arrangement, the second set of sheets to be folded, each sheet of the second set of sheets to be folded having at least one panel of a second predetermined length after being folded, the second predetermined length being greater than the first predetermined length;

wherein:

during the step of handling the first set of sheets, the first extent of material is received by the excess material receiving component; and during the step of handling the second set of sheets, the second extent of material is received by the excess material receiving component, the second extent of material being greater than the first extent of material.

10. The method of claim 9, wherein handling the first set of sheets includes transferring the sheets of the first set of sheets to a second processing roll having a second excess material receiving component and handling the second set of sheets includes transferring the sheets of the second set of sheets to the second processing roll, wherein transferring the sheets of the second set of sheets to the second processing roll includes transferring the second extent of material from the excess material receiving component to the second excess material receiving component.

11. The method of claim 10, wherein transferring the second extent of material from the excess material receiving component to the second excess material receiving component occurs proximate a nip formed between the roll and the second processing roll.

12. The method of claim 9, further comprising retaining the second extent of material in the excess material receiving component using a material retaining mechanism.

13. The method of claim 9, further comprising biasing the second extent of material into the excess material receiving component; wherein the step of biasing the second extent of material is performed by pushing the second extent of material with a projection of a biasing roll positioned adjacent the roll.

14. The method of claim 9, wherein the excess material receiving component is in the form of at least one ditch provided by the roll and the second extent of material is received in the at least one ditch.

15. The method of claim 9, wherein:

during the step of handling the first set of sheets, each sheet of the first set of sheets extends angularly about the rotational axis of the roll through a first angle;

during the step of handling the second set of sheets, each sheet of the second set of sheets extends angularly about the rotational axis of the roll through a second angle; and the first and second angles are equal.

16. The method of claim 9, wherein:

handling the second set of sheets includes holding each sheet of the second set of sheets on an upstream side of the excess material receiving component at a first location and on a downstream side of the excess material receiving component at a second location;

handling the second set of sheets further includes transferring the sheets of the second set of sheets to a second processing roll, the transferring including holding each sheet of the second set of sheets with the second processing roll at the first and second locations.

17. A method of processing sheets of web material, the method comprising:

forming a first set of sheets and a second set of sheets with the cutting arrangement of the apparatus of claim 1;

handling the first set of sheets with the roll of the cutting arrangement, each sheet of the first set of sheets having a first predetermined length extending between a leading edge and a trailing edge, handling of the first set of sheets defining a plurality of first handling regions, each first handling region extending angularly through a first angle about the rotational axis of the roll between a leading edge of the first handling region and a trailing edge of the first handling region, and handling the second set of sheets with the roll of the cutting arrangement, each sheet of the second set of sheets having a second predetermined length extending between a leading edge and a trailing edge, the second predetermined length being greater than the first predetermined length, handling of the second set of sheets defining a plurality of second handling regions, each second handling region extending angularly through the first angle about the rotational axis of the roll between a leading edge of the second handling region and a trailing edge of the second handling region;

the leading edges of the first handling regions being defined by leading edges of the sheets of the first set of sheets and the trailing edges of the first handling regions being defined by trailing edges of the sheets of the first set of sheets;

the leading edges of the second handling regions being defined by leading edges of the sheets of the second set of sheets and the trailing edges of the second handling regions being defined by trailing edges of the sheets of the second set of sheets;

wherein a first arc length between the leading edges and the trailing edges of the first handling regions is equal to a second arc length between the leading edges and the trailing edges of the second handling regions.

18. A method of forming sheets of web material of different lengths using the apparatus of claim 1, the method comprising:

in a first mode for forming the sheets of the first length:

receiving, by the roll of the cutting arrangement of the apparatus, the web of material;

receiving the first extent of material in the excess material receiving component; and severing the web of material after a predetermined amount of rotation of the roll to form the sheets of the first length;

in a second mode for forming the sheets of the second length:

receiving, by the roll of the cutting arrangement of the apparatus, the web of material;

receiving the second extent of material in the excess material receiving component, the second extent of material being greater than the first extent of material; and severing the web of material after the predetermined amount of rotation of the roll to form the sheets of the second length.

19. A method of processing sheets of web material, the method comprising:

forming a first set of sheets and a second set of sheets with the cutting arrangement of the apparatus of claim 1;

handling the first set of sheets, each sheet of the first set of sheets having a first predetermined length; and handling the second set of sheets, each sheet of the second set of sheets having a second predetermined length, the second predetermined length being greater than the first predetermined length;

wherein the steps of handling the first set of sheets and handling the second set of sheets are performed with the roll of the cutting arrangement; and wherein:

during the step of handling the first set of sheets, the first extent of material is received by the excess material receiving component; and during the step of handling the second set of sheets, the second extent of material is received by the excess material receiving component, the second extent being greater than the first extent.

* * * * *